US006563898B1

(12) United States Patent
Vourvopoulos et al.

(10) Patent No.: US 6,563,898 B1
(45) Date of Patent: May 13, 2003

(54) METHOD AND PORTABLE APPARATUS FOR THE DETECTION OF SUBSTANCES BY USE OF NEUTRON IRRADIATION

(75) Inventors: George Vourvopoulos, Bowling Green, KY (US); Sandor Sudar, Debrecen (HU)

(73) Assignee: Western Kentucky University, Bowling Green, KY (US)

( * ) Notice: Subject to any disclaimer, the term of this patent is extended or adjusted under 35 U.S.C. 154(b) by 0 days.

(21) Appl. No.: 09/409,334

(22) Filed: Sep. 30, 1999

Related U.S. Application Data

(62) Division of application No. 08/878,938, filed on Jun. 19, 1997.

(60) Provisional application No. 60/042,414, filed on Mar. 26, 1997.

(51) Int. Cl.[7] ..... G21G 1/06

(52) U.S. Cl. ..... 376/159; 376/158; 378/88; 250/390.04; 250/358.1

(58) Field of Search ..... 376/158, 159; 378/88; 250/390.04, 358.1

(56) References Cited

U.S. PATENT DOCUMENTS

| | | | | |
|---|---|---|---|---|
| 2,965,757 A | | 12/1960 | Martin et al. | 250/83.3 |
| 2,991,364 A | * | 7/1961 | Goodman | |
| 3,648,515 A | | 3/1972 | Youmans | 73/152 |
| 3,832,545 A | | 8/1974 | Bartbo | 250/312 |
| 3,942,003 A | | 3/1976 | Apenherg et al. | 250/255 |
| 4,055,763 A | * | 10/1977 | Antkiw | 250/270 |
| 4,264,823 A | | 4/1981 | Slaughter et al. | 250/499 |
| 4,363,965 A | | 12/1982 | Soherman et al. | 250/302 |
| 4,464,569 A | * | 8/1984 | Flaum | 250/270 |
| 4,527,058 A | | 7/1985 | Smith, Jr. | 250/256 |
| 4,587,424 A | | 5/1986 | Grau | 250/270 |
| 4,661,701 A | | 4/1987 | Grau | 250/270 |
| 4,710,946 A | | 12/1987 | Hinch et al. | 378/62 |
| 4,756,866 A | | 7/1988 | Alvarez | 376/157 |
| 4,810,876 A | | 3/1989 | Wraight et al. | 250/256 |
| 4,864,142 A | | 9/1989 | Gomberg | 250/390.04 |
| 4,882,121 A | | 11/1989 | Grenier | 376/159 |
| 5,040,200 A | | 8/1991 | Etlinger et al. | 378/86 |
| 5,124,554 A | | 6/1992 | Fowler et al. | 250/358.1 |
| 5,159,617 A | | 10/1992 | King et al. | 378/57 |
| 5,200,626 A | | 4/1993 | Schultz et al. | 250/390.04 |
| 5,235,185 A | | 8/1993 | Albats et al. | 250/269 |
| 5,247,177 A | | 9/1993 | Goldberg et al. | 250/358.1 |
| 5,251,240 A | | 10/1993 | Grodzano | 376/157 |
| 5,278,418 A | * | 1/1994 | Broadhurst | |
| 5,282,235 A | | 1/1994 | Schmor et al. | 378/53 |
| 5,293,414 A | | 3/1994 | Ettinger et al. | 378/88 |
| 5,396,071 A | * | 3/1995 | Atwell et al. | |
| 5,434,408 A | * | 7/1995 | Smith, Jr. et al. | |
| 5,440,118 A | | 8/1995 | Roscoe | 250/269.6 |
| 5,446,288 A | | 8/1995 | Turner | 250/390.05 |
| 5,479,023 A | | 12/1995 | Bartle | 250/390.04 |
| 5,539,788 A | * | 7/1996 | Ruddy et al. | |
| 5,781,602 A | | 7/1998 | Fero et al. | 376/159 |
| 5,982,838 A | * | 11/1999 | Vourvopoulos | 376/159 |

* cited by examiner

*Primary Examiner*—Michael J. Carone
*Assistant Examiner*—John Richardson
(74) *Attorney, Agent, or Firm*—John F. Salazar; Middleton Reutlinger

(57) ABSTRACT

The present invention relates to a method and portable apparatus which is used to detect substances, such as explosives and drugs, by neutron irradiation. The apparatus has a portable neutron generating probe and corresponding controllers and data collection computers. The probe emits neutrons in order to interrogate an object. The probe also contains gamma ray detectors for the collection of gamma rays from fast neutron, thermal neutron and neutron activation reactions. Data collected from these detectors is sent to the computer for data de-convolution then object identification in order to determine whether the object being interrogated contains explosives or illicit contraband.

13 Claims, 10 Drawing Sheets

| | Backgrd | Oxygen | Sulfur | Chlorine | Carbon | Other |
|---|---|---|---|---|---|---|
| Intensity [c/s] | 15923 | 8.5 | 55.8 | 23.0 | 16.8 | 36.9 |
| Error [c/s] | 621 | 2.4 | 1.2 | 1.9 | 0.8 | 1.4 |

METHOD AND PORTABLE APPARATUS FOR THE DETECTION OF SUBSTANCES BY USE OF NEUTRON IRRADIATION

This application is a divisional of U.S. patent application Ser. No. 08/878,938 filed Jun. 19, 1997 which claims priority to Provisional Application Ser. No. 60/042,414 filed Mar. 26, 1997.

BACKGROUND OF THE INVENTION

1. Field of the Invention

The present invention relates to a method and portable apparatus which is used to detect substances, such as explosives and drugs, by neutron irradiation. More particularly, the present invention is directed towards an apparatus which utilizes gamma ray detection, said gamma rays emitted by the interrogated object after subjecting it to a neutron burst thereby providing the ability to calculate the concentration of an element in the object of interest.

2. Discussion of the Prior Art

High explosives and illicit drugs are primarily composed of the chemical elements of hydrogen, carbon, nitrogen and oxygen. Systems for the detection of these elements are fairly well known. These systems utilize the irradiation of such material by neutrons and detection of gamma photons emitted by the materials after subjecting them to said neutron burst. One technique of such detection is neutron activation analysis. These prior art devices utilize the known effect of gamma ray emission from the nucleus of the objects being interrogated after irradiation. The concentration of these gamma rays can be detected by gamma ray detectors and the signals analyzed to determine the concentrations of chemical elements which make up the object being interrogated. These elements are found in explosives or illicit drugs in differing quantities, ratios and concentrations. By calculating and determining said ratios and concentrations, it is possible to identify and differentiate drugs and other contraband from sugar or other materials by measuring the amount of hydrogen, carbon or other material contained in the interrogated object.

It is further understood that the process of producing gamma photons by the interaction of the nucleus of the inspected material with neutrons from a neutron generator can be effected by either of three processes. These include fast neutron, thermal neutron and neutron activation reactions. Thermal neutron reactions occur by the capture of a neutron by a nucleus producing an isotope which is de-excited by the emission of gamma radiation. Fast neutron reactions result in the inelastic scattering of a neutron on a nucleus which is de-excited by the emission of prompt gamma radiation, this interaction occurring only with fast neutrons having a high enough energy which is at least equal to that of the prompt gamma radiation. Finally, neutron activation reactions occur by the activation of a nucleus by a thermal or fast neutron which creates a radioactive nucleus having a certain life and which disintegrates thereby emitting activation gamma radiation.

Further, prior art devices which are disclosed in U.S. Pat. Nos. 5,293,414, 4,864,142 and 5,373,538 suffer from other problems including the non-portability of their devices and the effect of producing false positive results when interrogating the object. Such false positives can occur due to background radiation, failure to account for the orientation of the interrogated object and detectors and the statistical analysis which may cause a miscalculation of the occurrence of the appropriate materials. Most importantly, the need for an accurate and portable system for emission and detection of neutrons and gamma rays has been needed in order to properly allow the detection of explosives and other material in varying environmental situations and circumstances.

SUMMARY OF THE INVENTION

The present invention is for a portable method and apparatus for detection of particular elements by neutron irradiation. The apparatus utilizes a portable self-contained probe which contains gamma ray detectors and associated electronics, a neutron generator and power supply and shielding material which isolates the detectors from the neutron generator. The probe is small and is of such design that it may be placed in between or near interrogated objects. The probe additionally contains appropriate high voltage and low voltage power supplies in addition to associated data collection electronics. The probe is remotely connected to a low voltage power supply controller and a controller which properly maintains and controls the neutron generator. Further, the probe is remotely connected to a data acquisition computer which detects the appropriate signals generated by the gamma ray detectors and converts them to digital values. These values are then analyzed by elemental characterization software which determines in real time which constituent elements are present in the interrogated object.

Finally, the present invention comprises a portable pulsed neutron detection system for detection of specific elements in an object, comprising: a portable probe, said probe having a pulsed neutron generator and at least one gamma ray detector; a controller operably connected to said pulsed neutron generator for varying the intensity and pulse characteristics of said pulsed neutron generator so as to emit a beam of neutrons from said generator; a data acquisition system operably connected to said at least one gamma ray detector for collecting data measured by said detector; and, means to analyze said data to determine the chemical composition of said object.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

The method and apparatus for a neutron based portable system for detection of specific elements is described herein. There are three separate elements which comprise the method and apparatus of the present invention. They include: (i) the portable probe and control equipment; (ii) data de-convolution; and (iii) object identification. Each will be dealt with individually herein.

I. Probe Construction

Figure 1:
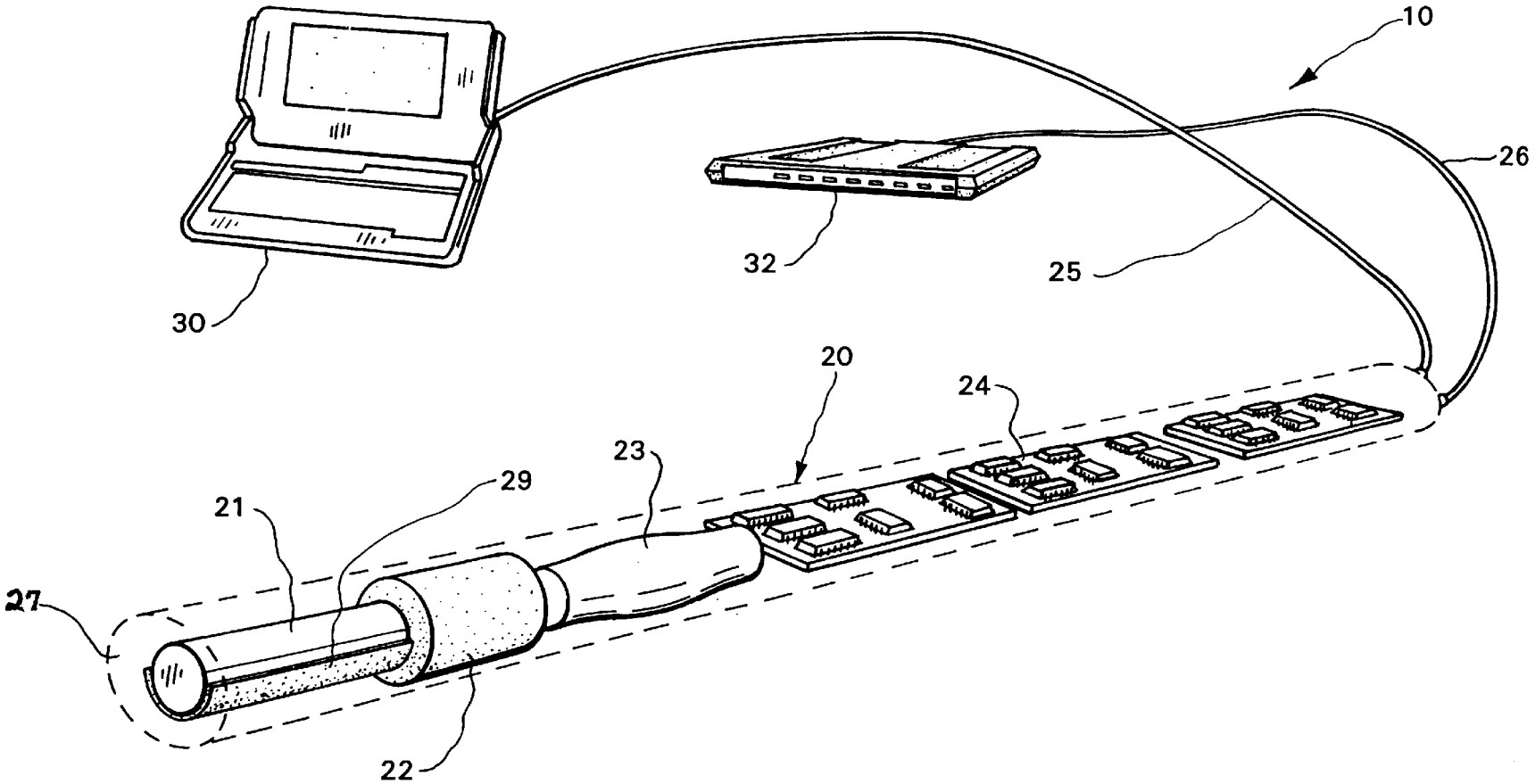
FIG. 1 is a schematic of the different elements of the apparatus of the present invention.

The apparatus is shown schematically in FIG. 1 wherein each of the separate elements of the portable apparatus 10 are shown. The portable pulsed neutron detection system 10 is comprised of multiple elements including the probe 10, low voltage power supply 32, portable computer 30, data and power lines 25 and 26. The entire apparatus is light-weight and easily movable which allows the apparatus 10 to be used in many different environments without the need of a heavy, permanently placed stand alone apparatus.

The probe 20 is constructed of multiple elements. The probe 20 is encased in a stainless steel cylindrical housing 27 and has a diameter of less than 5 cm. The probe has a length of around 2 meters and weighs around 36–45 kg. Inside the housing 27 is found the electronics and other apparatus for emitting, detecting and controlling the probe. At the distal end of the probe housing are found gamma ray detectors 21 for detection of the gamma rays emitted from the interrogated object after subjecting it to pulsed neutrons. Next in line within the probe 20 is found shielding material 22 which separates the neutron emitter 23 from the detectors 21. The pulsed neutron generator is found adjacent to the shielding material and emits pulses of neutrons at 14 MeV. Finally there is found within the probe housing 27 the electronics which generate the low and high voltage power supplies and electronics which control the gamma ray detectors.

The gamma ray detectors 21 found at the distal end of the probe 20 are high efficiency detectors made of Bismuth Germanate or Gadolinium Orthosilicate. The gamma ray detectors 21 are organized in linear geometry. The materials which constitute these gamma ray detectors are important in the operation of the present apparatus and should therefore be able to detect low intensities of the gamma rays. The orientation of the actual detectors within the probe does not particularly affect the efficiency of detection of levels corresponding to carbon, nitrogen and oxygen and a linear orientation is set forth herein for explanatory purposes. Many different orientations are possible as long as the probe calibration is adjusted appropriately.

These detectors are temperature stabilized to avoid any changes in the light collection efficiency. Thus, the analog amplitude of the signal generated from the gamma ray detectors 21 does not deviate for a given gamma ray detected. The temperature stabilization is accomplished through a thermo-electrically controlled jacket which surrounds each detector. Each detector is connected to a photomultiplier which changes the optical or light output of the detector to a voltage signal. A resistor chain and preamplifier provide high voltage to the photomultiplier and shape and pre-amplify the analog photomultiplier output. The resistor chain is connected to the base of the photomultiplier tube.

After pre-amplification, each gamma ray signal detected by the detectors 21 is sent through the data link 25 to the data acquisition system or computer 30. The data acquisition system 30 is comprised of multiple parts consisting of an amplifier, an analog to digital converter, voltage stabilizers and live-time correction. The live-time correction of the gamma-ray detection signals acts to correct for the delay in which the analog to digital converter is busy analyzing and converting data.

Within computer 30, the analog signals provided by the photomultiplier representing the counts of gamma photons detected by detectors 21 during a specified time period are amplified and converted to representative digital values by an analog to digital converter. The amplitudes of the signals received by the computer 30 fluctuate within a range of 0–10 Volts and correspond to the energy channel or level of each gamma ray detected by the gamma ray detectors 21. The analog to digital converter utilized in the data acquisition system converts these amplitude values to digital values for use in the data deconvolution and object identification steps detailed herein. The digital value converted from this amplitude signal represents the number of detected gamma rays. These digital values are then stored in a database on the computer 30.

The neutron generator 23 is a sealed tube deuterium tritium neutron generator and provides pulsed neutrons at 14 MeV. Each pulse is several microseconds wide and has a frequency of between 10 kHz and 14 kHz. The pulse separation, depending on the pulse width and pulse frequency, varies between 85 and 90 microseconds. These pulsed neutrons initiate the fast neutron reactions described above within the object being interrogated. Outgoing gamma rays emitted by the object are detected by the gamma ray detectors 21 for a specified time period. The gamma rays are measured and recorded as a single spectrum of data during that time period in the data acquisition system 30. At the end of the neutron pulse, the fast neutrons are thermalized at which point they initiate neutron capture reactions with the object. The gamma rays from these reactions are detected again by the detectors 21 and they are stored similarly as with the prior spectrum data. However, this spectrum data is offset within the computer systems 30 memory so as to have two distinct spectrum data from separate time periods.

The ability to measure two separate gamma ray spectra created by these reactions and store said data utilizing the same equipment provides a significant advantage over prior art devices. Previously, detecting and storing two distinct gamma ray spectra has required separate electronic components. Further, the present apparatus and method utilizes data collected from a third spectrum from the activation analysis. To detect elements through activation analysis, the neutron generator bombards the object under interrogation for a few minutes or a few seconds, depending on the material being detected. For example, phosphorus must be bombarded for proper detection for about 5 minutes while sodium only requires about 30 seconds. The generator is then turned off and the activation gamma rays are acquired for a time equal to the bombardment time. The activation data is then further utilized to determine the material contained within the object under interrogation.

Figure 8:
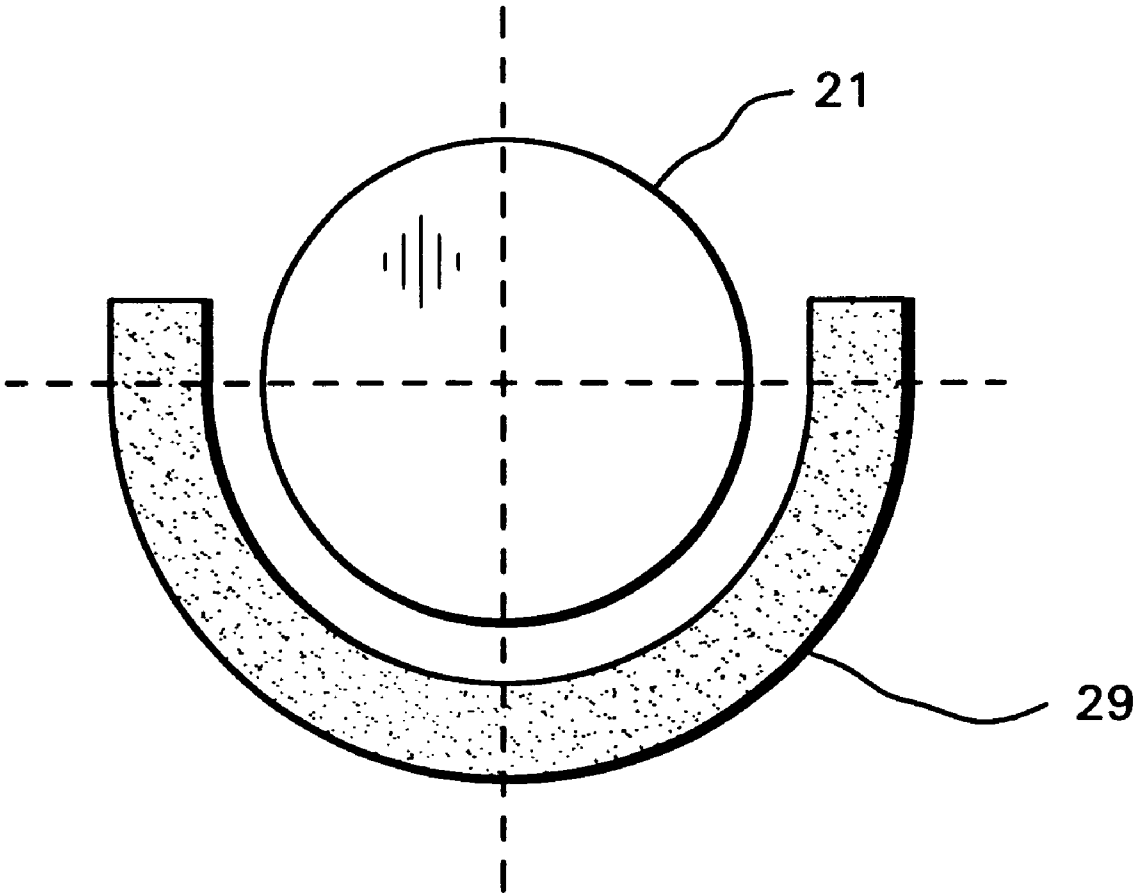
FIG. 8 is a side view of the detector and shielding configuration.

Radiation shielding 22 and 29 is provided and comprised of a high atomic number material such as lead or bismuth. The shielding 22 separates the gamma ray detectors within the probe from the neutron generator 23. Additional shielding 29 is also provided concentrically around each of the detectors 21, surrounding it through at least 125 degrees, and preferably around 235 degrees. This shielding prevents detection of gamma rays emitted from the generator tube 23 and from materials in the background. The concentric shielding 29 provided on the detectors 21 allows the probe to differentiate the contents of two objects when the probe 20 is placed between them. One spectrum of data may be taken with the concentrical shielding 29 towards one of the objects and another is measured with the shielding towards another object. The preferred embodiment of the probe construction contains shielding about 235 degrees of the detector as is shown in FIG. 8.

Voltage supply 24 provides 6 V, 12 V and 24 V low voltage for the detectors electronics and the neutron generator electronics. The voltage supply 24 also provides 900 V to 1300 V high voltage for the detectors 21. Differing values of the supplied voltage may be required due to varying requirements from the specific type of detector utilized. Three thousand volts (3,000 V) are provided for the pulsing of the neutron beam and 110,000 V high voltage is provided for the deuterium acceleration within the neutron generator. The probe 20 can also operate with a high voltage power supply residing external of the cylindrical probe 20 thereby reducing the size of probe 20. Such external connection to a high voltage supply would require a high voltage connector between the probe and supply.

Neutron generator controller 32 controls the pulsing of the neutron generator 23 and is designed according to the specific design requirements of the particular application. The controller 32 additionally provides controlling logic for the low voltage supplied by voltage supply 24. Additionally, controller 32 can contain diagnostic electronics for the operation of probe 20.

Figure 9:
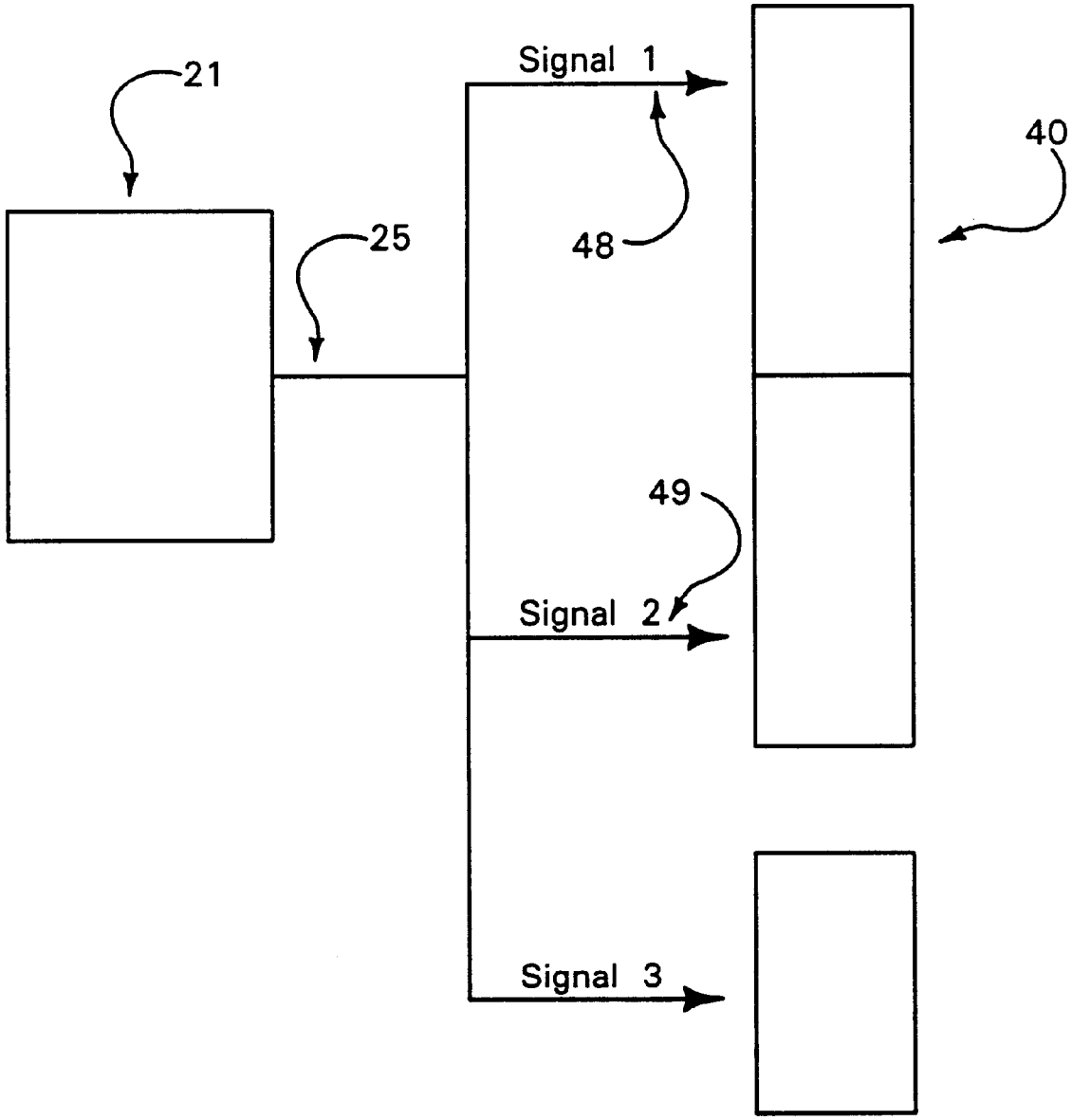
FIG. 9 is a schematic of the memory signal offsetting function of the computer; and, FIG. 10 is a schematic of the processing flow within the data acquisition system for generating the fitted spectrum.

Computer 30 is powered by the low voltage power supply 24 and is connected to the probe via data link 25. Computer 30 conducts the appropriate amplification and conversion of the analog data signals generated by the gamma ray detectors 21. Computer 30 also produces the appropriate offset of the gamma ray spectra so that the same analog to digital converter can be used for the separate acquisition of gamma rays produced from both fast and thermal neutrons on the same detector. The computer 30 additionally contains the appropriate software for data reduction and elemental characterization which allow real time analysis of the data. The relationship of the spectra of data collected by each detector and the manner in which computer 30 stores said data are shown in FIG. 9 wherein the detector 21 is shown as well as memory 40 such that when a signal is provided by the detector 21 through cables 25, the data is typically stored in a single memory space due to the fast detection and storage requirements inherent in these types of detection systems. However, due to the requirement of storing two sets of data generated at two different time periods, said periods being within microseconds of each other, the computer offsets the write portion in memory where the data is stored. The fast neutron signals typically last 14 Fs and are represented as signal 1 in FIG. 9 as 48. This signal is stored in the upper portion of the memory storage area for that particular detector 21. After 14 Fs, the thermal neutron signal 49 is generated. Without the offsetting of the write portion of the computer for saving these data, the second set of data would overwrite the first set of data detected representing fast neutrons. Thus, in this short time period, computer 30 offsets the write pointers in order to properly store the data for multiple sets of signals detected by detectors 21. This cycle is repeated for several seconds or minutes, depending on the investigation carried out. For the neutron activation data, since no cycling is involved and the neutron generator is turned off, the output from detector 21 in FIG. 9 is stored as signal 3 in a separate part of the computer memory. Upon completion of the data acquisition, the acquired files are transferred to the de-convolution computer code residing within computer 30 for analysis.

Data link cables 25 and 26 are coaxial shielded cables that provide the probe with the necessary voltages and carry to the controller 32 and computer 30 the detector signals and diagnostic signals. The cables can have a length of up to 17 m allowing the operation of the probe from varying distances.

II. Data De-Convolution

Figure 2:
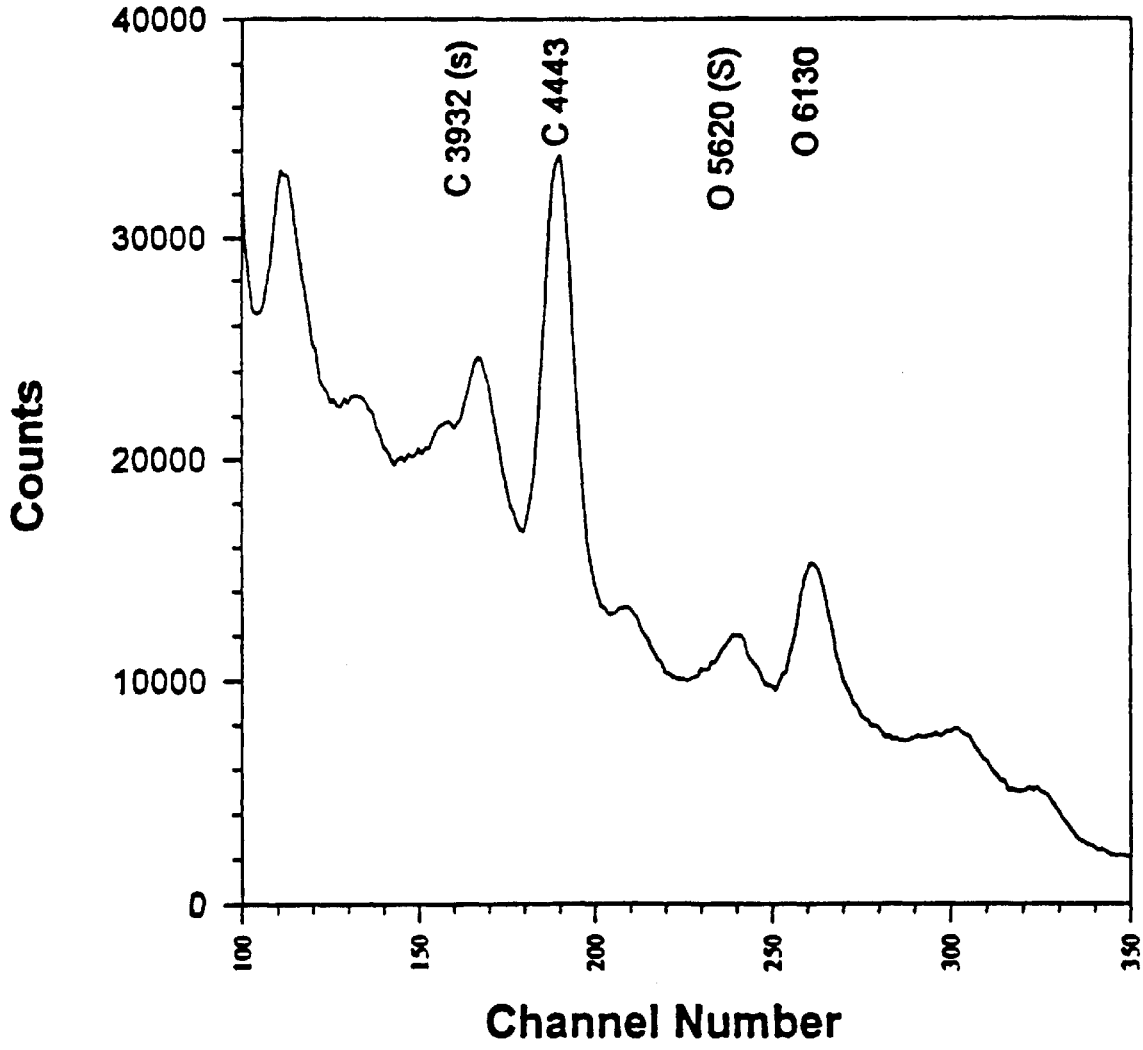
FIG. 2 is a graph of the gamma-ray spectrum for fast neutron reactions.
Figure 3:
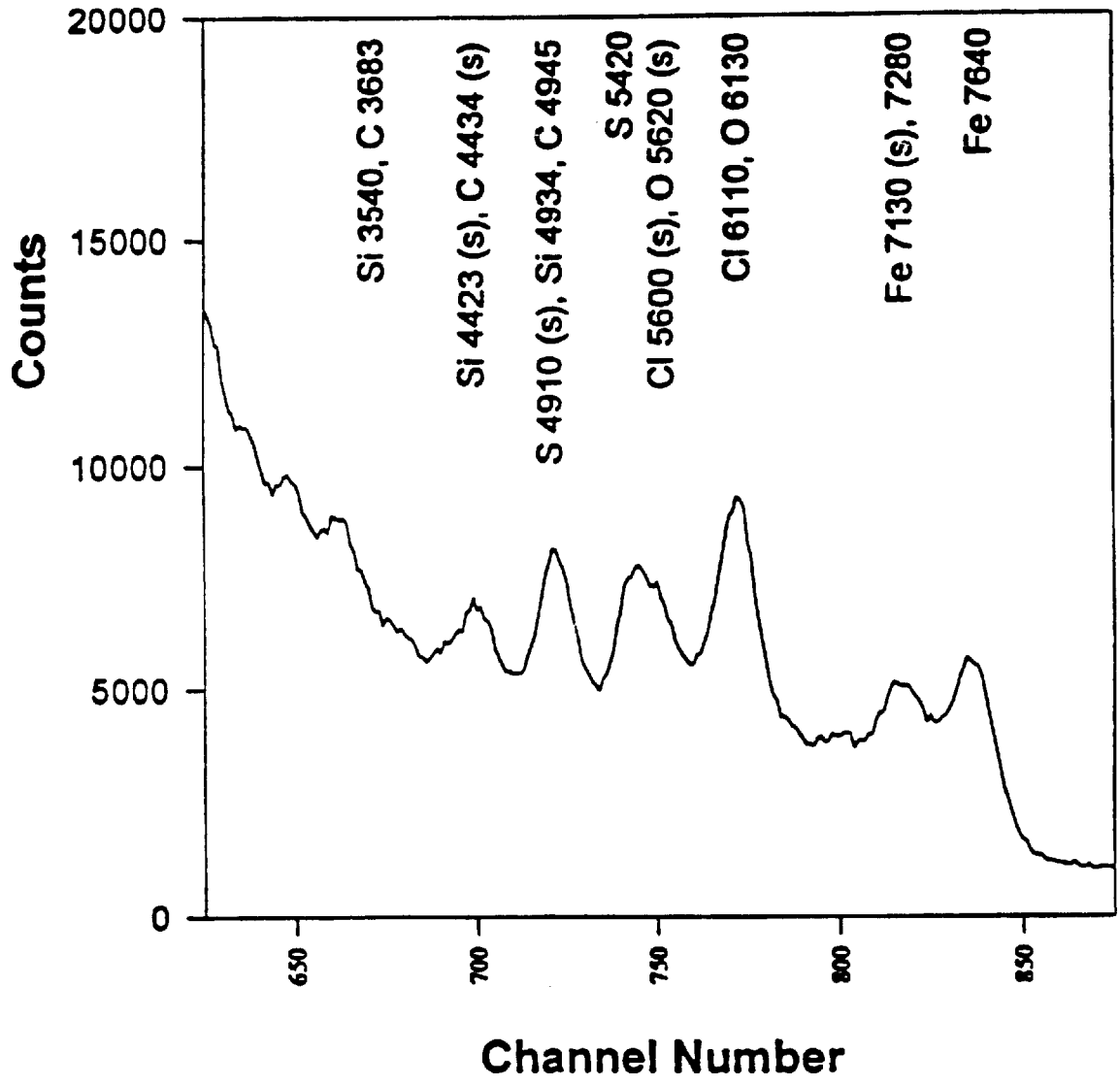
FIG. 3 is a is a graph of the gamma-ray spectrum for thermal neutron reactions.
Figure 4:
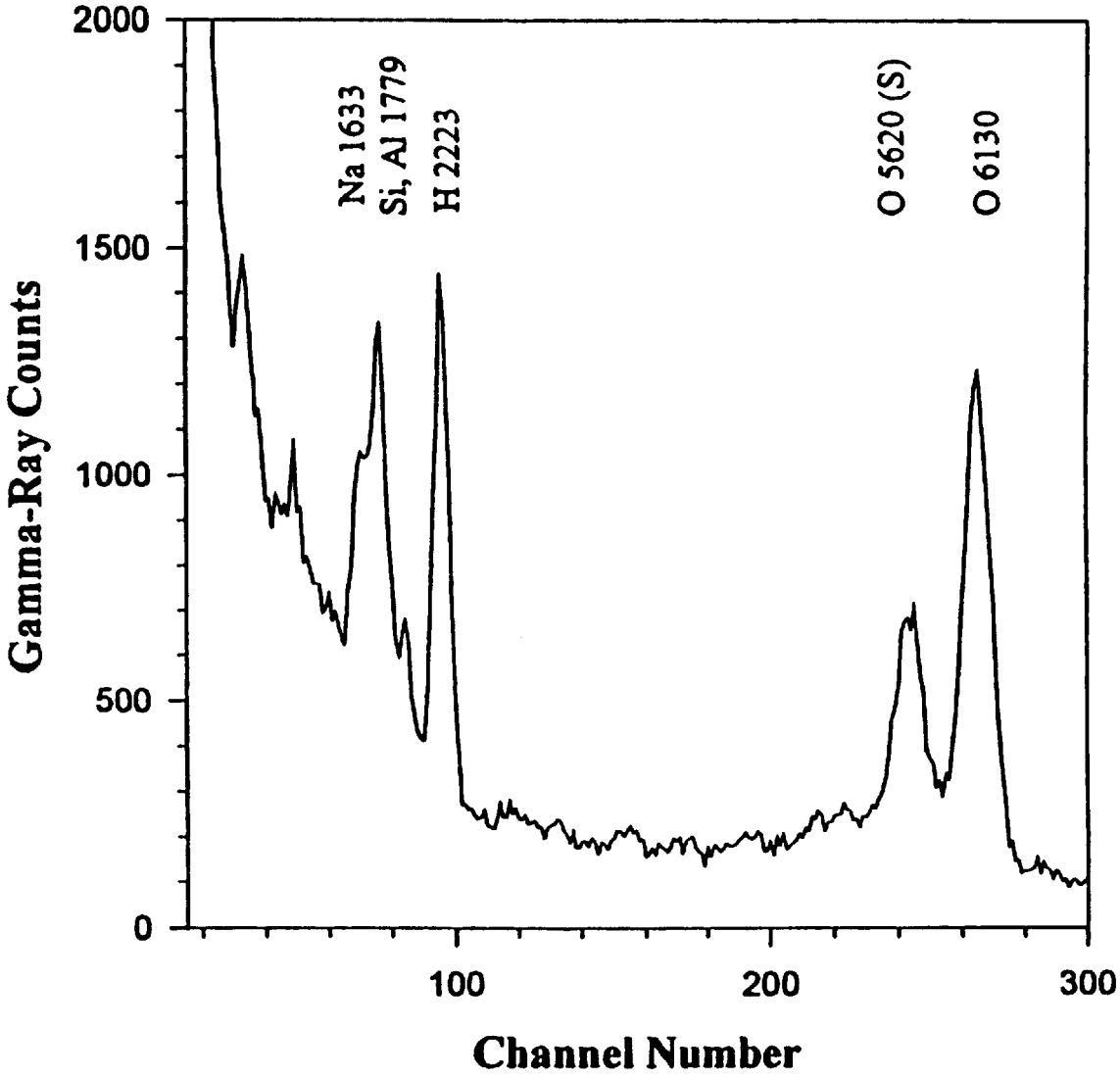
FIG. 4 is a graph of the gamma-ray spectrum for neutron activation reactions.
Figure 5:
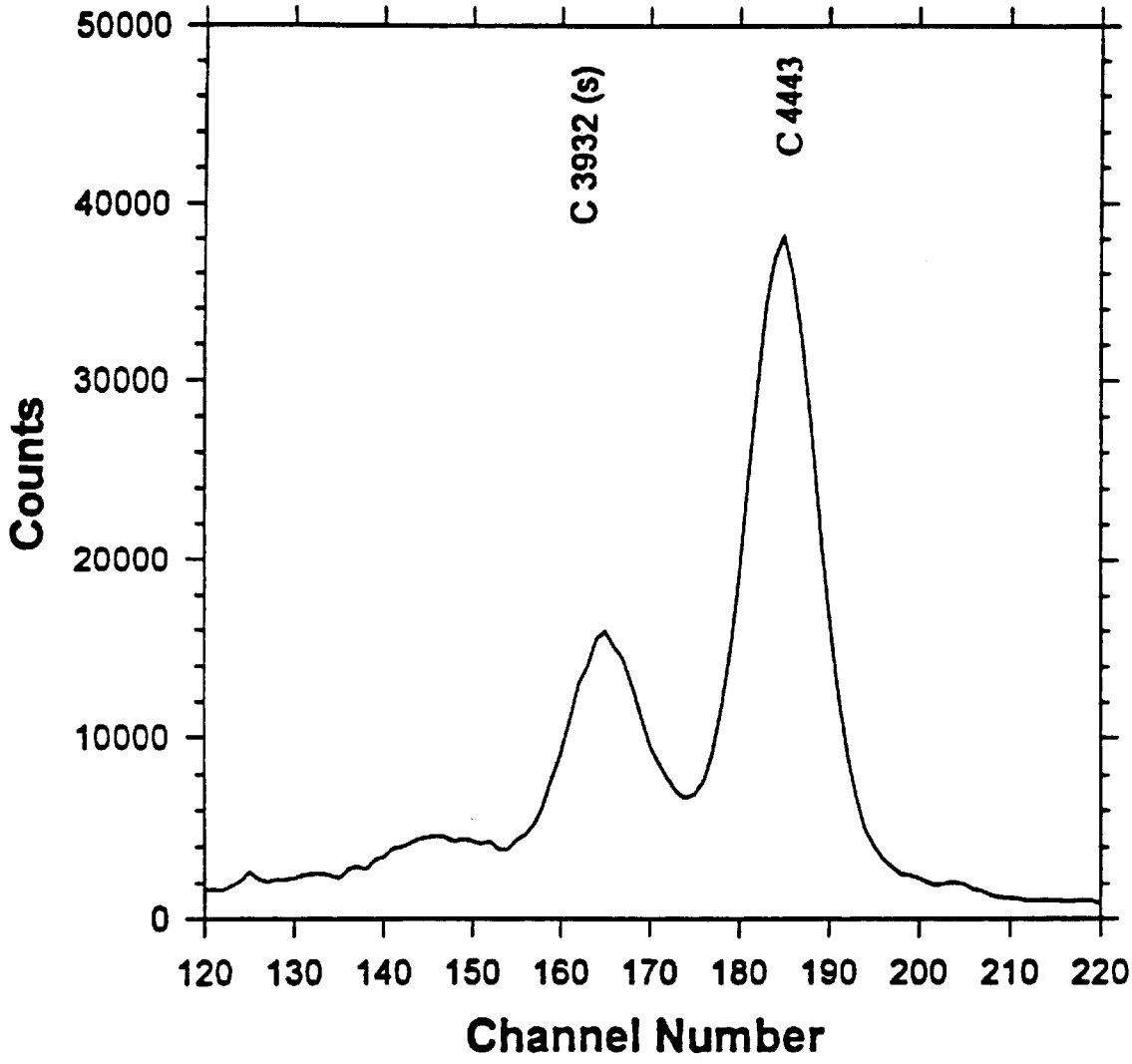
FIG. 5 is an example gamma-ray spectrum indicating the system detected response produced from a carbon sample bombarded with fast neutrons from the neutron generator.

Shown in FIGS. 2, 3 and 4 are gamma ray spectra from fast neutron, thermal neutron and neutron activation reactions. Each spectrum contains several gamma-rays produced from chemical elements contained in the interrogated object. The peaks in the spectrum, of FIGS. 2–6, represent particular elements present in the sample while the numbers associated with the peaks represent the energy, in kiloelectron volts, of the respective gamma rays. Data is collected for the specific probe geometry or detector configuration utilized in probe 20. Each probe is required to be properly calibrated based upon actual physical configuration of detectors 21, size of detectors, shielding geometry and position of the generator relative to the detectors. For a given detector and a given detection geometry, geometry meaning the probe configuration, each chemical element produces a characteristic gamma ray spectrum which is called a response spectrum. FIG. 5 shows a response spectrum produced from a carbon sample placed in front of the gamma ray detector bombarded with fast neutrons from the neutron generator 23. A gamma ray spectrum from any innocuous material or from a suspect drug or explosive will contain several chemical elements including hydrogen, carbon, nitrogen and oxygen. Depending on the packaging and surrounding materials, it can also contain elements such as silicon, chlorine, iron, lead or other elements. In the absence of any sample placed in front of the detector, the detector 21 will record gamma rays emanating from the materials surrounding the detector as well as from the materials inside and around the neutron generator 23. This spectrum is called the background spectrum. The de-convolution computer code used for the reduction of the data represents the counts or incidences of gamma rays in each energy channel of the spectrum by the equation:

$$f[i] = \sum_k c_k * m_k[i] + a * bg[i] \tag{1}$$

where f[i] is the number of counts in the i-th energy channel of the fitted spectrum, $c_k$ is the multiplication coefficient for the response spectrum of the k-th element, $m_k[i]$ is the number of counts in the i-th energy channel of the response spectrum of the k-th element, a is the multiplication coefficient of the background, and bg[i] is the number of counts in the i-th energy channel of the background. The $m_k[i]$'s are determined by measuring the spectrum of a sample containing only one chemical element (the response spectrum). The coefficients $c_k$ and a are determined by the least squares method, minimizing the general $c^2$ expression:

$$c^2 = \sum_i (y_i - f[i])^2 / s_i^2 \tag{2}$$

where $y_i$ and $s_i$ are the measured counts in the i-th energy channel and the statistical error respectively.

For a given probe configuration (position of detectors 21 relative to the neutron generator, size of each detector, which as previously indicated are cylindrical and 2.5 to 5 cm in diameter and 5 cm in length, collimation of each detector, etc.), response functions are measured for all the major and minor chemical elements (hydrogen, oxygen, chlorine, etc.) that are expected to be detected. To measure a response function, a sample containing primarily the chemical element of interest is placed in front of the detector. The neutron generator is turned on and a spectrum is accumulated. For some elements, such as chlorine, the response spectrum is due primarily to thermal energy neutrons. In this case the response spectrum will be used for the analysis of data from this particular neutron energy. In other cases such as earbon, a gamma ray response spectrum can be formed from both fast neutron arid thermal neutron reactions. Finally, the gamma ray response from thermal, fast neutron and activation reactions may all be utilized. All these response spectra are stored as a library in the computer. As long as the probe configuration is not altered, these spectra can be used irrespective of the locality where the probe is used and the type of object being interrogated.

When the probe is to be used for specific interrogation, the probe is placed at the position where the measurement is to take place. Without placing in front of the detector the object to be interrogated, the probe is turned on and a spectrum is taken under the exact same conditions (pulsing frequency, time interval of data accumulation) as it would be used for the measurement of the object under interrogation. In the case of an object that cannot be removed, a spectrum is taken at a distance from the object but in its vicinity. This spectrum is called the background spectrum. Since separate spectra are accumulated for fast neutron and thermal neutron induced reactions, these are two distinct background spectra recorded. While the response spectra remain the same for a given probe configuration, irrespective of where the probe is used, the background spectrum is specific to the measurement. Prior to the initiation of the measurement, the background spectrum is examined, the major and minor chemical elements present in it are recognized and recorded.

When a spectrum is accumulated, it is displayed and all major and minor chemical elements which were not observed in the background spectrum are also recorded. The de-convolution software is started and the major and minor chemical elements present in the background and the actual spectrum are listed. The software uses this list of elements for accessing from the library the response spectra of the elements of interest. The computer 30 additionally displays the specific background spectra.

Figure 6:
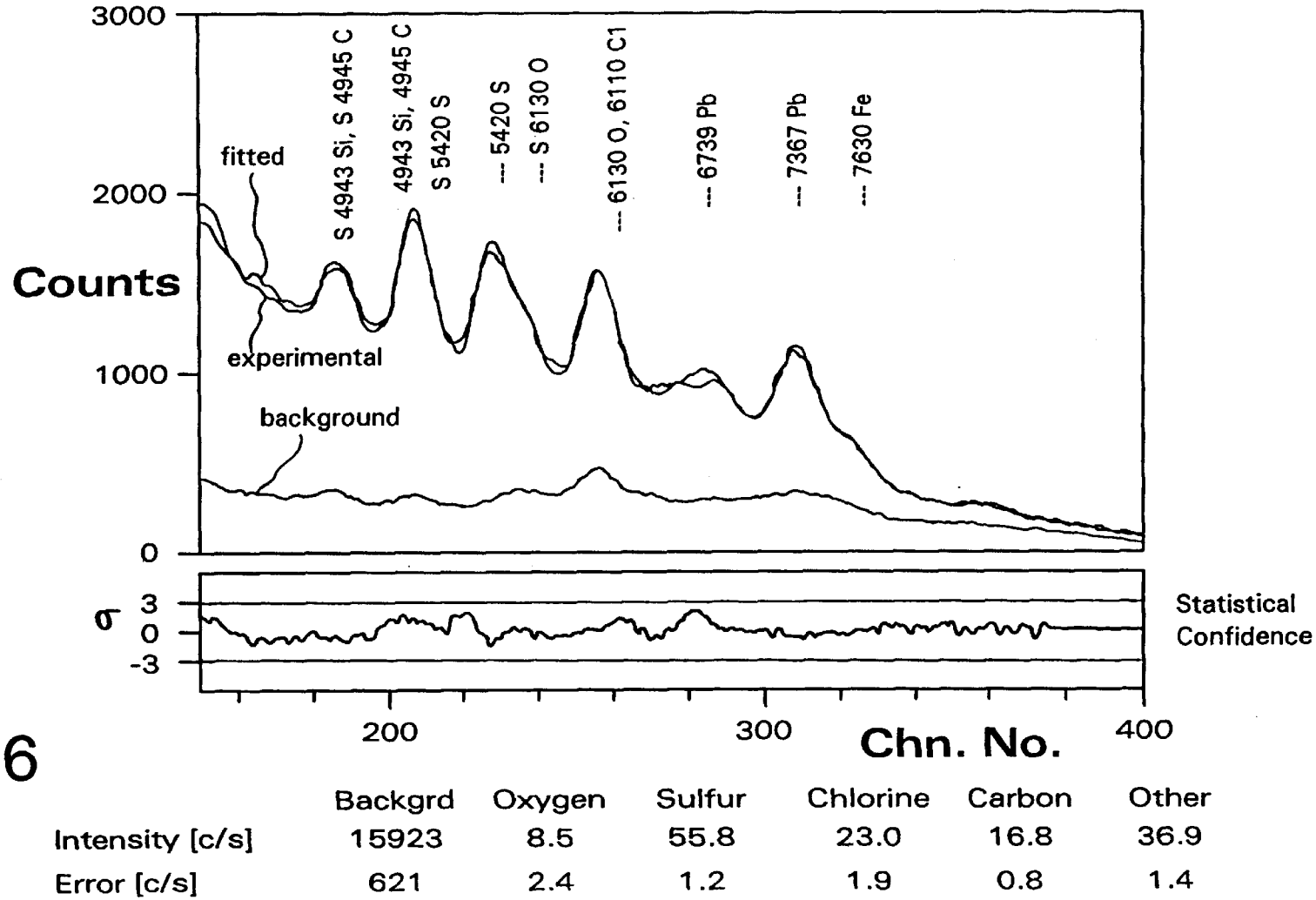
FIG. 6 is a graphical representation of the experimental and fitted spectra of gamma rays and a representation of the background spectrum along with the statistical confidence of the differing elements.
Figure 10:
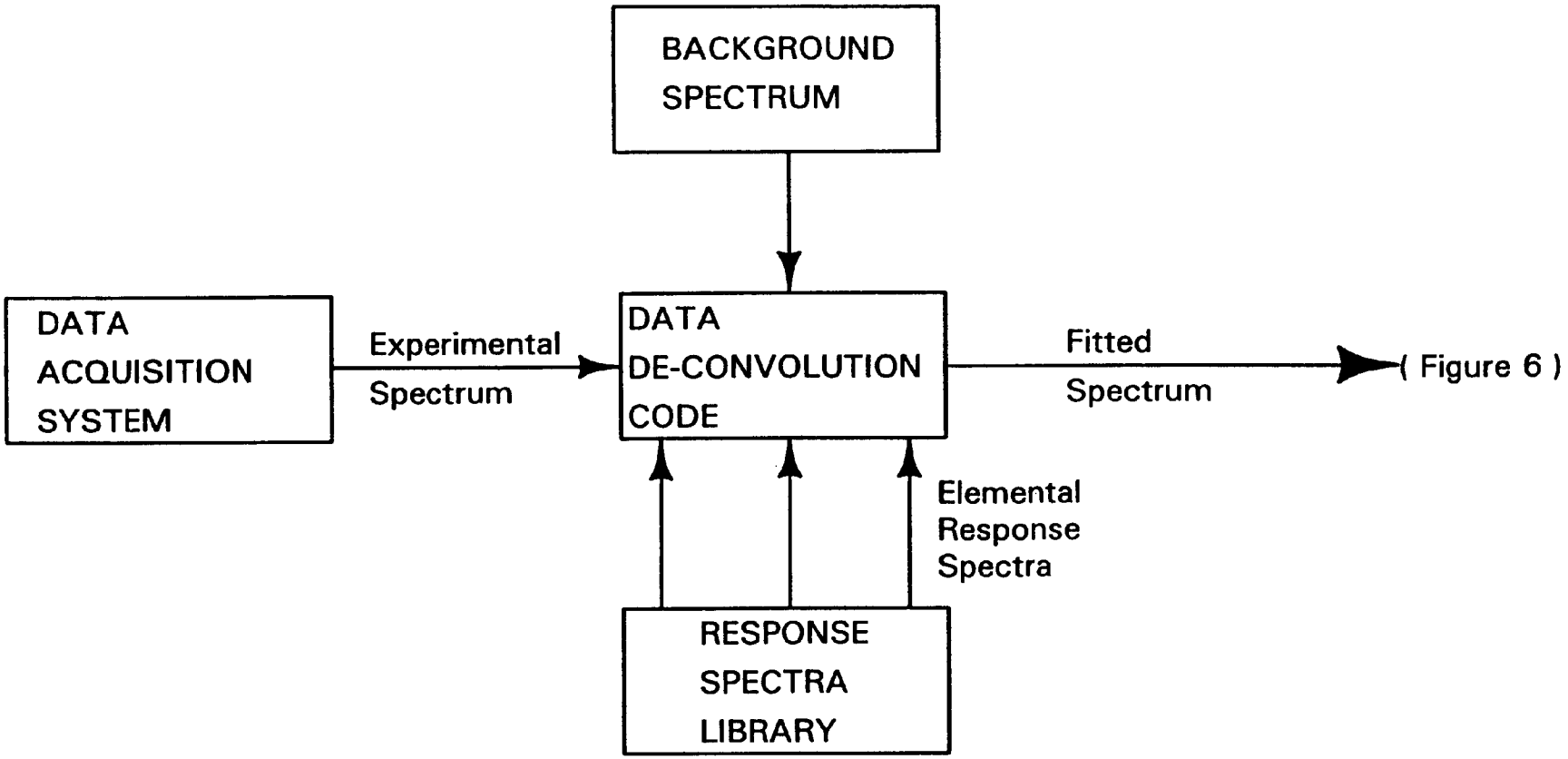

The data de-convolution software, using the information generated, utilizes equations (1) and (2) and provides a best fit to the data. To generate the best fit data shown in FIG. 6, multiple spectra are produced based upon assumptions in the content of the object being examined. The de-convolution code assumes certain amounts of each element of interest in the sample being interrogated. These assumed amounts are then utilized to generate a fitted spectrum utilizing the above referenced equations. Multiple iterations of adjusting the amounts of the assumed elements are then attempted by the de-convolution code until a best fit of the experimental spectrum is produced. This process is represented in the schematic of FIG. 10. The results of the best fit can be displayed as shown in FIG. 6. The figure contains the experimental spectrum, the fitted spectrum and the background spectrum. Below the spectra the difference at each energy channel between the experimental and fitted spectrum is displayed. The two horizontal lines above and below the difference spectrum are the 3s lines indicating 99% confidence limit. A table is also provided with the number of counts (in the form of counts per second or any other time unit desired) for each major and minor element detected above the background, along with the error for this measurement.

III. Object Identification

The de-convolution software provides information on the chemical elements contained in the interrogated object. This information is utilized in several ways depending on the environment of the object under interrogation. If the investigation is of same size objects under standard geometry conditions, the probe 20 can be calibrated absolutely so that the gamma ray counts for each element would correspond to a specific elemental content. This interrogation would correspond to a fixed probe configuration for interrogation of same-sized objects placed at a fixed position relative to the probe. To calibrate the probe for each element, samples with specific elemental composition are analyzed, and measured gamma ray counts versus elemental concentrations are established. An example of such analysis would be the examination of projectiles of similar size containing the same amount of explosives of differing composition.

Figure 7:
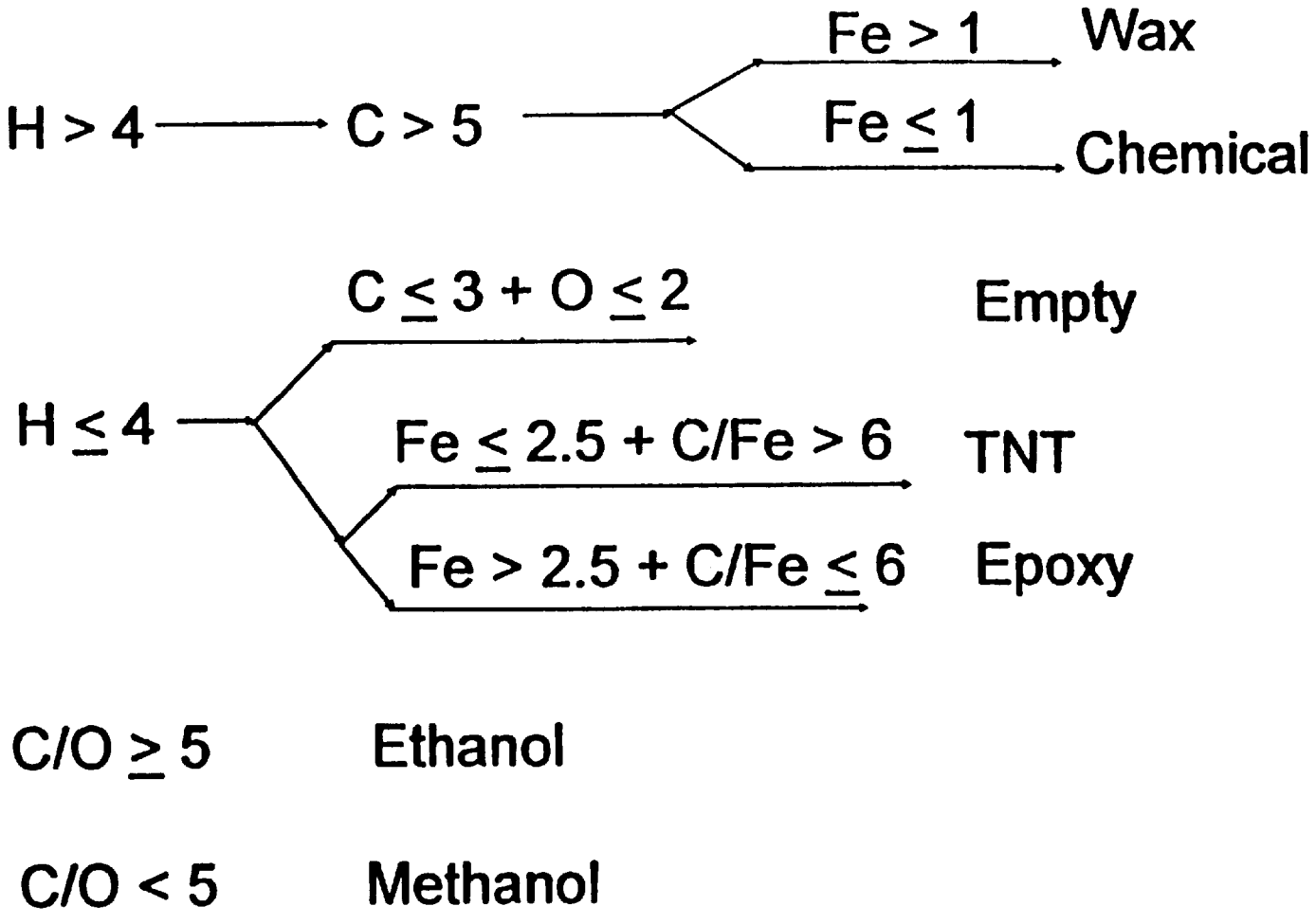
FIG. 7 is an example of a decision tree which the software utilizes in order to determine the elements found in the interrogated object.

If the probe cannot be calibrated absolutely because the contents of the same sized objects vary in composition and density, the elemental composition of each object with differing content is established under the same geometry conditions. To differentiate and identify each object, a decision tree is made that depends on the elemental content of certain elements as well as elemental ratios of other elements. Such a decision tree is shown in FIG. 7.

When interrogating objects under random conditions, if the elemental content cannot be uniquely determined from the number of counts for each element, elemental ratios can be uniquely determined. Ratios such as carbon to oxygen and carbon to nitrogen can be measured irrespective of the size of the object and position of the probe relative to the object. As an example, drugs hidden within innocuous materials such as coffee or sugar can be found by placing the probe close to the material and measuring the carbon to oxygen ratio. For sugar, the carbon to oxygen ratio is 1.1, for coffee it is 1.8, while for heroin and cocaine, it is 4.2. If the calculated number differs from the ratio expected for coffee or sugar by an amount larger than 3s, one can say with 99% confidence that the material contains something different than coffee or sugar.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed is:

1. A method for detecting illicit substances using pulsed neutron detection, comprising:

storing a database of response spectra for various elements of interest;

irradiating an object with pulsed neutrons to create fast neutron reactions, thermal neutron reactions and neutron activation reactions;

generating a spectrum by detecting the gamma rays emitted by said object using a plurality of gamma ray detectors for fast neutron reactions, thermal neutron reactions and neutron activation analysis;

accumulating a spectrum of gamma ray photons for each of said reactions;

recognizing the individual elements contained in said accumulated spectrum of gamma ray photons;

retrieving from a library a response spectra for each of said recognized elements;

generating a fitted spectrum by repetitively varying the amounts of each of said retrieved response spectra of each of said recognized elements until said fitted spectrum closely matches said accumulated spectrum.

2. The method of claim 1 wherein said fitted spectrum represents the counts of gamma rays at each energy channel by the equation:

$$f[i] = \sum_k c_k * m_k[i] + a * bg[i]$$

where f[i] is the number of counts in the i-th energy channel of the fitted spectrum, $c_k$ is the multiplication coefficient for the response spectrum of the k-th element, $m_k$[i]is the number of counts in the i-th channel of the response spectrum of the k-th element, a is the multiplication coefficient of the background, and bg[i] is the number of counts in the i-th energy channel of the background.

3. The method of claim 2 wherein said coefficients $c_k$ and a are determined by the least squares method, minimizing the general $c^2$ equation:

$$c^2 = \sum_i (y_i - f[i])^2 / s_i^2$$

where $y_i$ and $s_i$ are the measured counts in the i-th energy channel and the statistical error respectively.

4. The method of claim 1 wherein said method further comprises:

measuring the background radiation spectrum for fast neutron and thermal neutron reactions;

removing said background spectrum from said accumulated spectrum; and, generating said fitted spectrum on said data with said background spectrum removed.

5. The method of claim 1 wherein said detecting illicit substances further comprises:

generating a decision tree based upon said detected individual elements contained within said object;

determining if said individual elements detected in said object are consistent with an illicit material;

notifying the operator if said ratio is consistent with illicit materials.

6. The method of claim 1 wherein said pulses of neutrons are at about 14 MeV.

7. The method of claim 1 wherein the pulses of neutrons have a frequency of between 10 kHz and 14 kHz.

8. The method of claim 1 wherein said detecting illicit substances further comprises:

calculating the ratios of recognized elements contained in said object;

determining if said ratios are consistent with illicit materials; and, notifying the operator if illicit materials are determined to be evident in said object.

9. A method for detecting illicit substances using pulse neutron detection, comprising:

storing a database of response spectra for various elements of interest;

irradiating an object with pulsed neutrons at about 14 MeV, to create fast neutron reactions, thermal neutron reactions and neutron activation reactions;

detecting gamma rays using a plurality of gamma ray detectors;

generating a spectrum from said detected gamma rays based upon fast neutron reactions, thermal neutron reactions and neutron activation analysis;

accumulating a spectrum of gamma rays for each of said fast neutron, thermal neutron and neutron activation reactions;

recognizing individual elements represented by said accumulated spectrum;

retrieving from a library a response spectrum for each of said recognized elements;

generating a fitted spectrum based upon said recognized elements; and, determining the ratios of said recognized elements.

10. The method of claim 9 wherein said fitted spectrum represents the counts of gamma rays at each energy channel by the equation:

$$f[i] = \sum_k c_k * m_k[i] + a * bg[i]$$

where f[i] is the number of counts in the i-th energy channel of the fitted spectrum, $c_k$ is the multiplication coefficient for the response spectrum of the k-th element, $m_k$[i]is the number of counts in the i-th channel of the response spectrum of the k-th element, a is the multiplication coefficient of the background, and bg[i] is the number of counts in the i-th energy channel of the background;

and further wherein said coefficients $c_k$ and a are determined by the least squares method, minimizing the general $c^2$ equation:

$$c^2 = \sum_i (y_i - f[i])^2 / s_i^2$$

where $y_i$ and $s_i$ are the measured counts in the i-th energy channel and the statistical error respectively.

11. The method of claim 10 wherein said method further comprises:

measuring the background radiation spectrum for fast neutron and thermal neutron reactions;

removing said background spectrum from said accumulated spectrum; and, generating said fitted spectrum on said data with said background spectrum removed.

12. The method of claim 10 wherein said detecting illicit substances further comprises:

generating a decision tree based upon said detected individual elements contained within said object;

utilizing said decision tree to determine if said individual elements detected in said object are consistent with an illicit material;

notifying the operator if said ratio is consistent with illicit materials.

13. A method for detecting illicit substances using pulse neutron detection, comprising:

storing a database of response spectra for various elements of interest;

irradiating an object with pulsed neutrons at about 14 MeV, to create fast neutron reactions, thermal neutron reactions and neutron activation reactions;

detecting gamma rays using a plurality of gamma ray detectors;

generating a spectrum from said detected gamma rays based upon fast neutron reactions, thermal neutron reactions and neutron activation analysis;

accumulating a spectrum of gamma rays for each of said fast neutron, thermal neutron and neutron activation reactions;

recognizing individual elements represented by said accumulated spectrum;

retrieving from a library a response spectrum for each of said recognized elements;

generating a fitted spectrum based upon said recognized elements;

determining the ratios of said recognized elements;

measuring the background radiation spectrum for fast neutron and thermal neutron reactions;

removing said background spectrum from said accumulated spectrum;

generating said fitted spectrum on said data with said background spectrum removed;

wherein said fitted spectrum represents- the counts of gamma rays at each energy channel by the equation:

$$f[i] = \sum_k c_k * m_k[i] + a * bg[i]$$

where f[i] is the number of counts in the i-th energy channel of the fitted spectrum, $c_k$ is the multiplication coefficient for the response spectrum of the k-th element, $m_k[i]$is the number of counts in the i-th channel of the response spectrum of the k-th element, a is the multiplication coefficient of the background, and bg[i] is the number of counts in the i-th energy channel of the background;

and further wherein said coefficients $c_k$ and a are determined by the least squares method, minimizing the general $c^2$ equation:

$$c^2 = \sum_i (y_i - f[i])^2 / s_i^2$$

where $y_i$ and $s_i$ are the measured counts in the i-th energy channel and the statistical error respectively.

* * * * *

UNITED STATES PATENT AND TRADEMARK OFFICE

CERTIFICATE OF CORRECTION

PATENT NO. : 6,563,898 B1
DATED : May 13, 2003
INVENTOR(S) : George Vourvopoulos and Sandor Sudar It is certified that error appears in the above-identified patent and that said Letters Patent is hereby corrected as shown below:

Column 7,
Line 9, change “earbon” to -- carbon --;
Line 10, change “arid” to -- and --;

Column 11,
Line 15, change “represents-” to -- represents --.

Signed and Sealed this

Second Day of December, 2003

JAMES E. ROGAN
*Director of the United States Patent and Trademark Office*